US005163512A

United States Patent [19]

Brewer et al.

[11] Patent Number: 5,163,512

[45] Date of Patent: Nov. 17, 1992

[54] MULTI-ZONE OPEN HOLE COMPLETION

[75] Inventors: James R. Brewer; Kurt D. Koehler, both of Bakersfield, Calif.

[73] Assignee: Shell Oil Company, Houston, Tex.

[21] Appl. No.: 751,397

[22] Filed: Aug. 28, 1991

[51] Int. Cl.[5] ..... E21B 43/00

[52] U.S. Cl. ..... 166/313; 166/51; 166/278

[58] Field of Search ..... 166/313, 51, 278, 185, 166/285, 297

[56] References Cited

U.S. PATENT DOCUMENTS

| | | | |
|---|---|---|---|
| 2,436,198 | 2/1948 | Cardwell et al. | 252/8.55 |
| 4,105,069 | 8/1978 | Baker | 166/51 |
| 4,273,190 | 6/1981 | Baker et al. | 166/278 |
| 4,295,524 | 10/1981 | Baker et al. | 166/278 |
| 4,474,239 | 10/1984 | Colomb et al. | 166/278 |
| 4,633,944 | 1/1987 | Zunkel et al. | 166/51 |
| 4,700,777 | 10/1987 | Luers | 166/185 |
| 4,842,057 | 6/1989 | Lubitz | 166/278 X |
| 4,858,691 | 8/1989 | Ilfrey et al. | 166/51 X |
| 4,917,188 | 4/1990 | Fitzpatrick, Jr. | 166/295 |
| 4,945,991 | 8/1990 | Jones | 166/278 |

*Primary Examiner*—Thuy M. Bui

[57] ABSTRACT

Casing comprising fiberglass or another readily millable material are included in a casing string at intervals which are to be produced. The millable sections are then milled to provide for a multi-zone open hole completion.

12 Claims, 2 Drawing Sheets

MULTI-ZONE OPEN HOLE COMPLETION

FIELD OF THE INVENTION

This invention relates to a method and apparatus for providing a multi-zone open hole completion in a wellbore.

BACKGROUND OF THE INVENTION

Sand migration is a constant problem when fluids are produced from unconsolidated subterranean formations. When loose sand is removed from the formation by fluids flowing toward a wellbore, the sand can plug fluid passages, damage oil production equipment, and settle from the produced fluids as a sludge. The sludge creates a maintenance and disposal problem. Sand migration is minimized by placement of sand or fine gravel around a screen or slotted liner in the wellbore with the fluid producing formation. This is typically referred to as a gravel pack. The gravel pack provides a volume for the migrating sands to deposit or be filtered from the production fluids.

Gravel packs are often most effective in an open hole completion. An open hole completion does not utilize a casing within the producing formation. A gravel pack may be placed between a perforated casing and a smaller diameter slotted or screened liner, but the produced fluids must be channeled through the perforations, where fluid velocities are increased. The gravel packing is less effective in the regions of higher fluid velocities. Open hole completions are therefore generally preferred when a gravel pack is necessary.

Multiple zone completions are also often desirable. A multiple zone completion utilizes a single wellbore to produce fluids from mulitple strata. The oil producing strata may be separated by brine bearing strata, in which case the brine bearing strata must be cased and cemented. Multiple zone completions are often not practical due to differeing formation pressures, and therefore the possibility of cross flow between strata. But when multiple zones can be produced from each wellbore, the cost savings are obviously significant.

When multiple zone completions can be utilized, open hole completions have generally not been utilized in the upper zones. To utilize open hole completions in a well which is to produce from multiple zones, it has been necessary to case the entire well, cement the well, and then mill out casing and cement within the strata to be produced. The zones between the producing zones must be cased in order to accomplish a good cement job between producing formations. Milling of casing to permit open hole completions in upper zones is expensive and time consuming. It can take about one hour of milling for each foot of casing to be removed. A drilling rig is therefore required for about ten extra hours for each ten-foot-thick zone to be completed. Although expensive, this process has occasionally been utilized because of the accumulative benefits of multiple zone completions and open hole completions.

Fiberglass casing is also known in the art. Fiberglass casing is particularly useful when fluids or gases being injected or produced through the wellbore are highly corrosive, but the use of fiberglass is limited to wells in relative low temperature formations due to plastic deformation temperatures which approaches the temperatures of many production wells. Fiberglass casing is also only useful at fairly shallow depths due to limited collapse strength. Further, fiberglass casing is generally more expensive then steel casings.

It is therefore an object of the present invention to provide a method to provide a multiple zone open hole completion wherein the completion process is considerably less time consuming and thus less expensive than the prior art processes of milling out cemented steel casings within the producing formations. In another aspect, it is an object to provide a casing string which comprises a combination of readily millable segments and steel sections wherein the readily millable segments align with producing strata which intersect a wellbore.

SUMMARY OF THE INVENTION

These and other objects of this invention are accomplished by a method comprising:

a) placing a casing within the wellbore, the portion of the casing in the vicinity of a plurality of oil-bearing strata being a millable material and another portion of the casing being steel;

b) cementing the casing into the wellbore from below a lower oil-bearing strata to above an upper oil-bearing strata; and c) milling out a portion of the millable casing and cement in the vicinity of the lower oil-bearing strata and the upper oil-bearing strata.

Alternatively, the borehole may be drilled to the top of a lower oil-bearing strata, and then the borehole can be cased and cemented with the millable casing in the region of the upper oil-bearing strata. The millable casing can then be removed, and the borehole extended into the lower oil-bearing strata to provide the multiple zone open hole completion.

The preferred millable material is fiberglass because fiberglass casings are available and reasonably priced. Fiberglass casings can be milled at rates of about one foot per minute and greater, and have sufficient strength to provide a casing for the purpose of cementing the permanent casing both above and below the oil-bearing strata. The method of this invention also minimizes the time which an open hole must be left in unconsolidated or poorly consolidated formations. This minimizes the potential of the formation sloughing off into the open hole or otherwise being damaged during the drilling and completion process.

DETAILED DESCRIPTION OF THE INVENTION

Figure 1A:
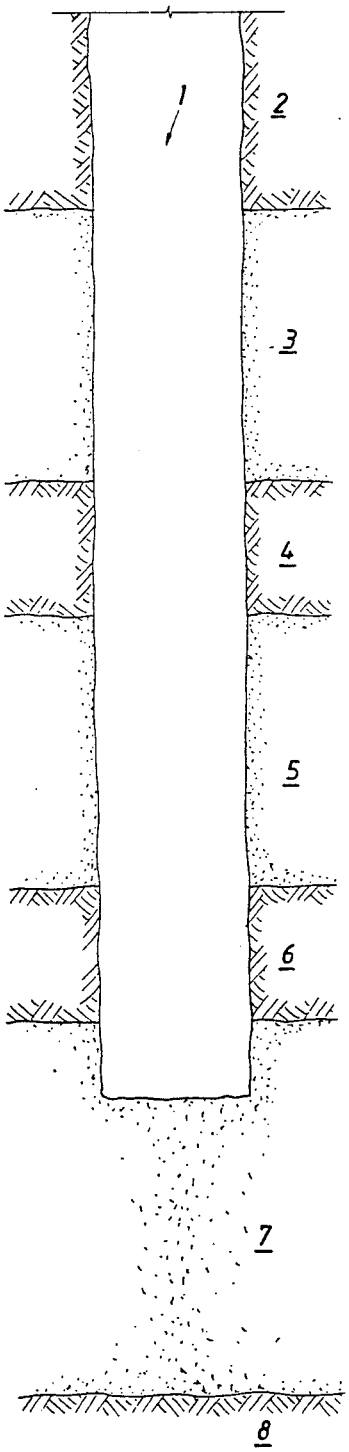
FIG. 1A displays an open hole drilled through an upper oil-bearing strata and into an upper portion of a lower oil-bearing strata.

Referring to FIGS. 1A through 1E, various stages of implementation of one embodiment of the method of this invention are displayed. FIG. 1A shows a wellbore, 1, drilled through an upper oil-bearing strata, 3. The upper oil-bearing strata, 3, is bound by impermeable layers, 2 and 4. The wellbore, 1, extends to the upper portion of a lower oil-bearing strata, 7. The lower oil-bearing strata is bound by impermeable stratas, 6 and 8. A formation from which production is not desired, 5, lies between the upper and the lower oil-bearing strata. The strata from which production is not desired, 5, may be, for example, a water-bearing sand formation. The impermeable stratas, 2, 4, 6, and 8, may be, for example, shales or clays. The oil-bearing stratas, 3 and 7, may be, for example, sands, or limestones. The oil-bearing strata may be consolidated or unconsolidated, but the present invention is best utilized in unconsolidated sands due to the benefits of an open hole completion in such a formation. Only two oil-bearing strata are shown although the present invention could be utilized with any number of oil-bearing strata separated by strata from which production is not desired.

The wellbore, 1, could alternatively be drilled entirely through the lowest oil-bearing strata in the practice of the present invention, although it is preferred to drill only to about the upper portion of the lower oil-bearing strata. Initially drilling only to the top of the lowest oil-bearing strata avoids having to case and then remove the casing from the lower oil-bearing strata. The individual oil-bearing stratas may be from a few feet thick to over 100 feet thick. The oil-bearing strata may be separated vertically by a distance of from just a few feet to thousands of feet, but typically strata which can be produced in a multiple zone completion will be separated by about 100 feet or less. Greater separations can result in significantly different formation pressures and therefore cross flow between strata which are open to the same borehole.

Oil-bearing strata could, of course, contain varying amounts of gas. One or more strata could even contain only gas and still be "oil-bearing" as the term is utilized herein.

Figure 1B:
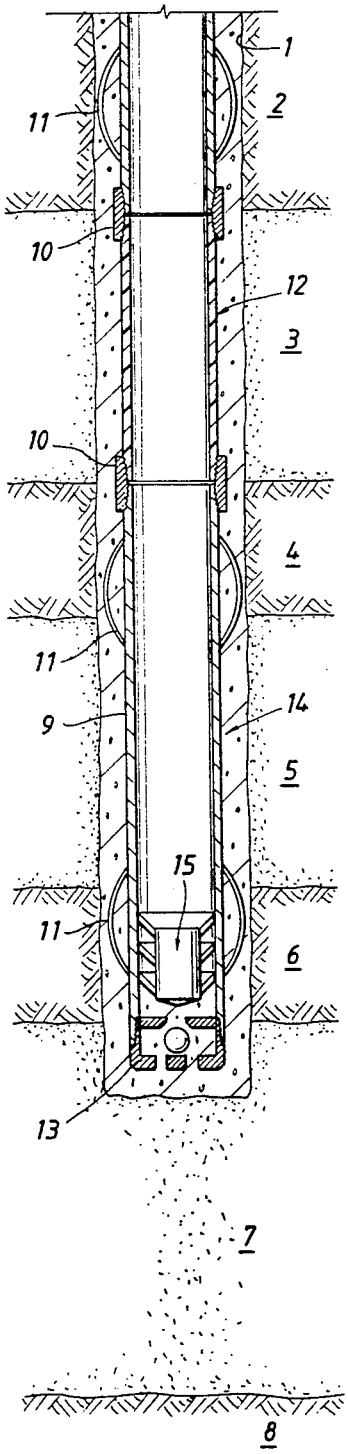
FIG. 1B displays a casing cemented into the open hole according to one embodiment of the present invention.

Referring to FIG. 1B, the borehole of FIG. 1A is shown with a casing cemented in place according to the present invention. The casing comprises steel casing joints, 9, connected by steel collars, 10, from the top of the casing to the top of uppermost oil-bearing strata. Centralizers, 11, around the casing, 9, maintain a clearance between the wellbore walls and the casing to provide a gap for cement flow and to prevent differential sticking of the casing to the wellbore wall. Within the upper oil-bearing strata, 3, millable casing, 12, is of a readily millable material. Fiberglass is preferred due to its commercial availability and reasonable cost. Other polymers may also be utilized, and soft metals such as aluminum are also acceptable. Centralizers, 11, are preferably located above and below the casing section of millable material. It is preferred to avoid placement of centralizers on the millable section of the casing to prevent any interference with the milling of the casing. Below the upper oil-bearing strata, the steel casing, 9, is again utilized. Steel casing is utilized where the casing is not to be later milled due to a slightly lower cost, better temperature stability, and greater strength. A cement shoe, 13, is located at the lower extremity of the casing string. A cement shoe typically contains a check valve to permit cement to be forced out of the casing and into the annulus between the casing and the wellbore wall, while preventing drilling mud or other contaminates from mixing with the contents of the casing while the casing is being lowered into the borehole. After the casing is in place, cement, 14, is forced out of the cement shoe and into the annulus between the casing and the wellbore wall. This cement, 14, provides a seal to prevent communication out of water-bearing or oil-bearing formations. The cement is followed down the casing by a wiper plug, 15. The wiper plug maintains a positive separation between the cement and the fluids which are used to force the cement out of the casing. The wiper plug, 15, the cement shoe, 13, and the cement itself must be of a drillable material if it is necessary to drill out of the bottom of the wellbore to complete a zone below the initial wellbore. Cementing of the casing into the wellbore is performed according to methods well known in the art, and many service companies are available to perform this cementing.

Figure 1C:
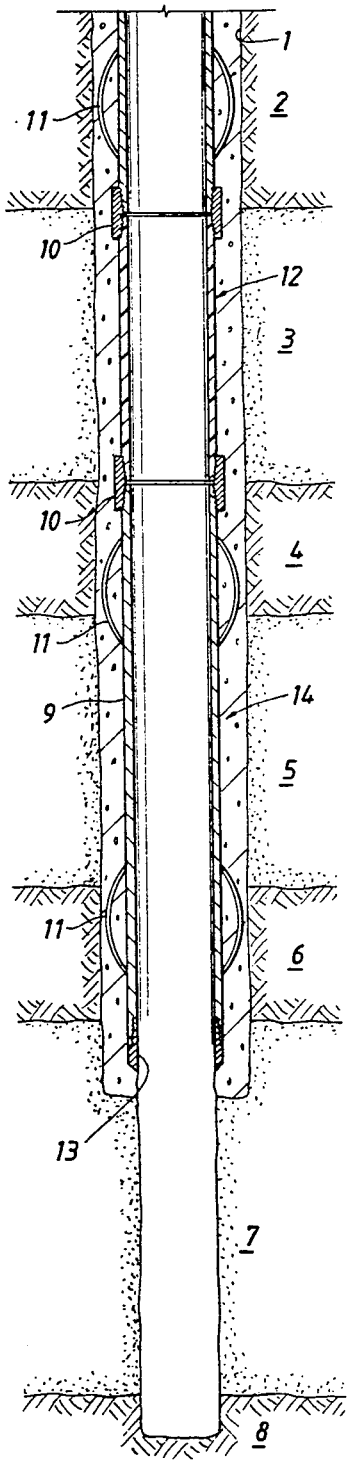
FIG. 1C displays a wellbore in which a casing is cemented into the wellbore. The casing extends to the upper portion of a lower oil-bearing strata and the wellbore has been extended through the lower oil-bearing strata.

Referring now to FIG. 1C, the wellbore of FIG. 1B is shown with the wellbore extended through the wiper plug, 15, cement shoe, 13, and the lower oil-bearing zone, 7. Drilling through this material would be a typical operation when the lower zone is to be completed as single zone open hole completion by the methods of the prior art.

Figure 1D:
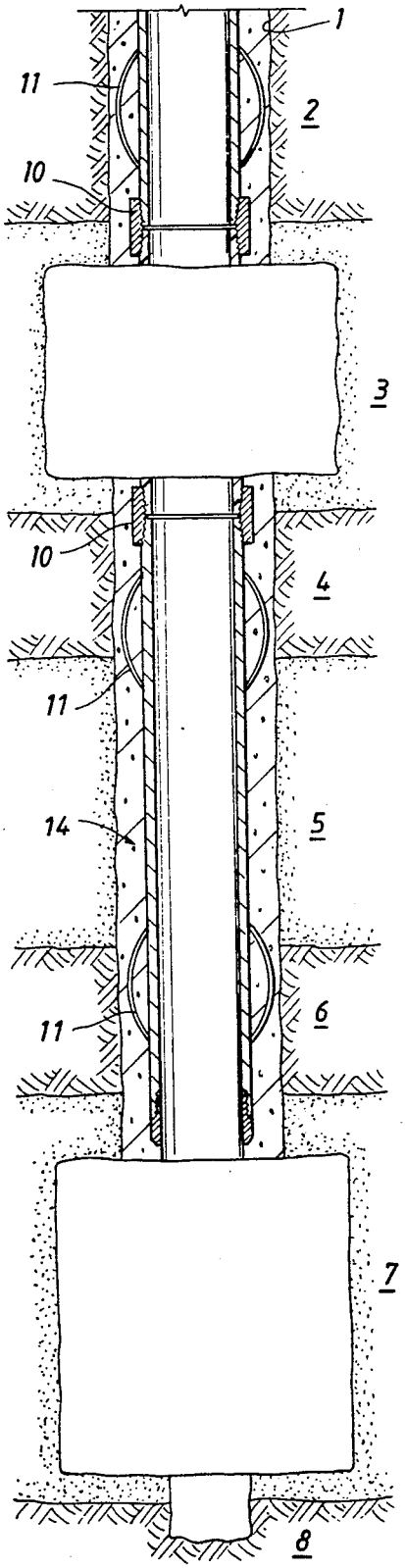
FIG. 1D displays the wellbore of FIG. 1C in which a section of the casing within the upper oil-bearing strata has been milled out, exposing the formation of the upper oil-bearing strata to the wellbore, and the wellbore in both the upper and the lower oil-bearing strata have been underreamed.

Referring to FIG. 1D, the wellbore of FIG. 1C is shown with a segment of the millable casing, 12, removed. Commercially available and well known section mills can be utilitzed to perform this milling. FIG. 1D also shows the segments of the wellbore within both the upper and the lower oil-producing formation underreamed to provide room for a gravel pack. It is preferred that most of the millable casing be removed to provide a maximum amount of open hole for hydrocarbon production, but some millable casing may be left to avoid running the mill against steel casing and collars.

Figure 1E:
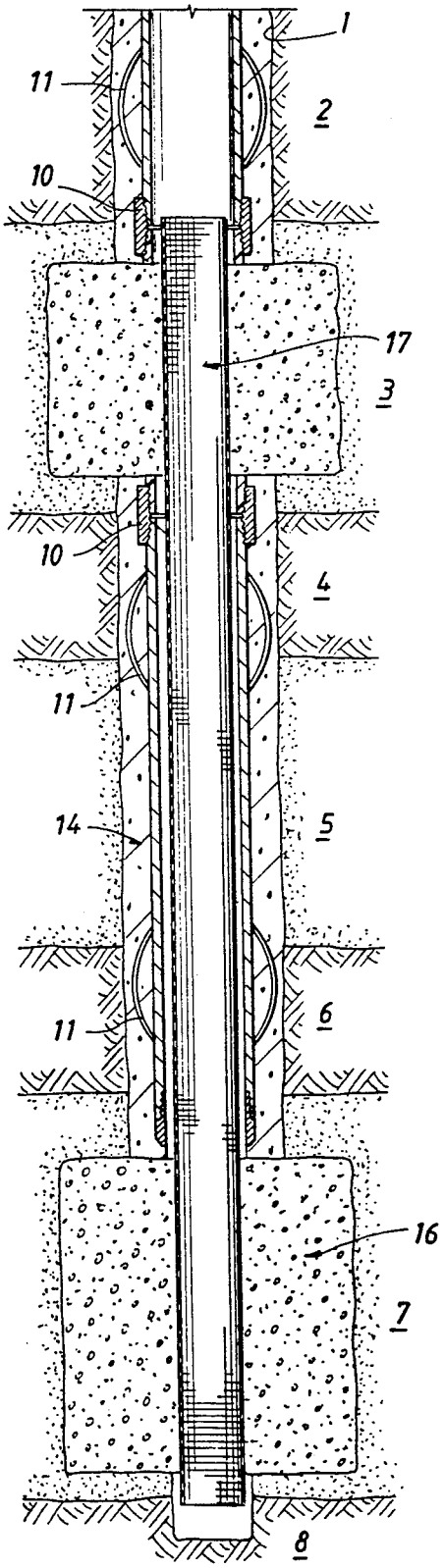
FIG. 1E displays the wellbore of FIG. 1D in which a gravel pack and screen have been placed.

Referring to FIG. 1E, the wellbore of FIG. 1D is shown with a liner, 17, and a gravel pack, 16, in place. The cement, 14, and casing, 9, serves to seal the wellbore from the sands from which production is not desired, 5, and from the formation above the upper oil-bearing strata, 2. The gravel packing into multiple zones does not differ from gravel packing for single zone completions which is well known in the art. Many service companies, such as Halliburton and Baker Sand Control, are available which can effectively provide such services.

The foregoing description of the invention is merely intended to be explanatory thereof, and various changes in the details of the described methods may be made within the scope of the appended claims without departing from the spirit of the invention.

We claim:

1. A method to provide a multiple zone open hole completion in a wellbore comprising:

a) placing a casing within the wellbore, the portion of the casing in the vicinity of a plurality of oil-bearing strata being a millable material and another portion of the casing being steel;

b) cementing the casing into the wellbore from below a lower oil-bearing strata to above an upper oil-bearing strata; and c) milling out a portion of the millable casing and cement in the vicinity of the lower oil-bearing strata and the upper oil-bearing strata.

2. The method of claim 1 wherein the wellbore extends, prior to placing the casing into the wellbore, to an upper portion of a lower oil-bearing strata.

3. The method of claim 2 further comprising the step of drilling the borehole further into the lower oil-bearing strata after the casing is cemented.

4. The method of claim 1 wherein the millable material is fiberglass.

5. The method of claim 1 wherein the casing of millable material is millable at a rate of about one foot per minute or greater.

6. The method of claim 1 wherein intervals of casing of the millable material in the vicinity of the oil-bearing strata are separated by intervals of steel casing.

7. The method of claim 4 wherein intervals of fiberglass casing in the vicinity of the oil-bearing strata are separated by intervals of steel casing.

8. A method to provide a multiple zone open hole completion in a wellbore traversing at least one upper oil-bearing strata, the process comprising:

drilling the wellbore to an upper portion of a lower oil-bearing strata;

placing a casing within the wellbore, the casing being of a millable material in the vicinity of at least one upper oil-bearing strata and steel in at least another portion of the wellbore, and extending from the upper portion of the lower oil-bearing strata up to above at least one upper oil-bearing strata;

cementing the casing into the wellbore from the upper portion of the lower oil-bearing strata up to above at least one upper oil-bearing strata;

milling a portion of the millable casing and cement in the vicinity of at least one upper oil-bearing strata;

drilling the wellbore into a lower portion of the lower oil-bearing strata.

9. The method of claim 8 wherein the millable material is fiberglass.

10. The method of claim 8 wherein the casing of millable material is millable at a rate of about one foot per minute or greater.

11. The method of claim 8 wherein the interval of casing from the upper portion of the lower oil-bearing strata up to a lower portion of an upper oil-bearing strata is a steel casing.

12. The method of claim 11 wherein the casing of a millable material is a fiberglass casing.

* * * * *